United States Patent [19]

Furuya et al.

[11] Patent Number: 4,845,072

[45] Date of Patent: Jul. 4, 1989

[54] THERMOSENSITIVE RECORDING MATERIAL

[75] Inventors: Hiromi Furuya, Shizuoka; Kiyotaka Iiyama, Mishima, both of Japan

[73] Assignee: Ricoh Company, Ltd., Tokyo, Japan

[21] Appl. No.: 123,243

[22] Filed: Nov. 20, 1987

[30] Foreign Application Priority Data

Nov. 20, 1986 [JP] Japan ..... 61-277646

[51] Int. Cl.[4] ..... B41M 5/18

[52] U.S. Cl. ..... 503/209; 427/150; 428/913; 503/207; 503/214; 503/216; 503/220; 503/223

[58] Field of Search ..... 427/150–152; 428/913, 914; 503/208, 209, 216, 225, 217, 207, 214, 220, 223

[56] References Cited

U.S. PATENT DOCUMENTS 4,539,578 9/1985 Igarashi et al. ..... 503/209

*Primary Examiner*—Bruce H. Hess

*Attorney, Agent, or Firm*—Oblon, Spivak, McClelland, Maier & Neustadt

[57] ABSTRACT

A thermosensitive recording material is disclosed, which comprises a support material and a thermosensitive coloring layer formed thereon, comprising a leuco dye, a color developer capable of inducing color formation in the leuco dye upon application of heat thereto, and a vinyl ether compound having the general formula, which serves as thermosensitivity improvement agent.

8 Claims, 4 Drawing Sheets

THERMOSENSITIVE RECORDING MATERIAL

BACKGROUND OF THE INVENTION

The present invention relates to a thermosensitive recording material, and more particularly to a thermosensitive recording material having excellent coloring sensitivity, capable of yielding images with high density, high degree of whiteness of the background and high image formation stability in which a vinyl ether compound is employed as thermosensitivity improvement agent.

A conventional thermosensitive recording material comprises a support material, such as a sheet of paper or a film, and a thermosensitive coloring layer formed thereon, which comprises a coloring system consisting of a colorless or light-colored coloring dye such as a leuco dye and a color developer capable of inducing color formation in the coloring dye upon application of heat thereto such as a phenolid compound (for example, Bisphenol A) and an organic acidic material. In addition to the above coloring system, the thermosensitive coloring layer further comprises a binder agent, a filler, a thermal sensitivity improvement agent, a lubricant and other auxiliary agents. Examples of such thermosensitive recording material are disclosed, for example, in Japanese Patent Publication No. 43-4160, Japanese Patent Publication No. 45-14039, and Japanese Laid-Open Patent Application No. 48-27736.

In a thermosensitive recording material of this type, a colored image is obtained by a chemical reaction between a coloring agent and a color developer upon application of heat thereto, for instance, through a thermal head which is built in a thermal printer or a facsmille apparatus.

Such thermosensitive recording material has the advantages over other conventional recording materials that recording can be performed in a short time by use of a comparatively simple device without the need for complicated processes such as developing and fixing, almost no noise is generated and no environmental pollution problems occur during operation, and the cost is low. Because of these advantages, the thermosensitive recording material has wide-scale utilization, not only as the recording material for copying books and documents, but also as the recording material for use with computers, facsimile apparatus, talex, medical instruments, other apparatus for recording information, and measuring instruments.

In accordance with the recent demand for high speed recording with high recording density, not only the development of a high speed recording apparatus, but also the development of recording materials that can be used with such a high speed recording apparatus is desired.

A first method by which the above demand could be met is to decrease the melting point of an electron acceptor serving as color developer as much as possible for use in practice, for instance to 80° to 120° C., taking into consideration the conditions for preserving the color developer, so that the co-melting initiation temperature with a leuco dye is decreased, thus it is tried to attain high speed recording. This method, however, will not be employed in practice, because it is extremely difficult to adjust the melting point of the phenolic compounds which are widely used as the color developer at present in the field of thermosensitive recording material, and because the cost of the phenolic compounds will become high if it is tried to do so.

A second method by which the above demand can be met to some extent is to add a thermofusible material to the thermosensitive coloring layer in such a manner that the thermofusible material is caused to work as a sensitizer or a melting point reducing agent for the thermosensitive coloring layer as described in Japanese Laid-Open Patent Applications Nos. 53-39139, 53-26139, 53-5636 and 53-11036. Examples of such a thermofusible material are various waxes, fatty acid amides, alkylated biphenyl, substituted biphenyl alkane, coumarin, coumarin derivatives, and diphenylamine. The density of the colored images, the coloring sensitivity and the degree of whiteness of the background obtained by the thermosensitive recording materials using such thermofusible materials in the thermosensitive coloring layer, however, are still poor.

SUMMARY OF THE INVENTION

It is therefore an object of the present invention to provide a thermosensitive recording material suitable for practical use in high speed recording, having high coloring sensitivity and capable of yielding images with high coloring density and high degree of whiteness of the background.

According to the present invention, the above object is attained by a thermosensitive recording material comprising a support material and a thermosensitive coloring layer formed thereon comprising a leuco dye, a color developer capable of inducing color formation in the leuco dye upon application of heat thereto, and a vinyl ether compound having the following general formula (I), with further addition of an auxiliary agent when necessary:

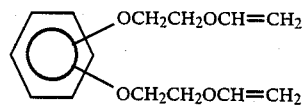

(I)

Figure 1:
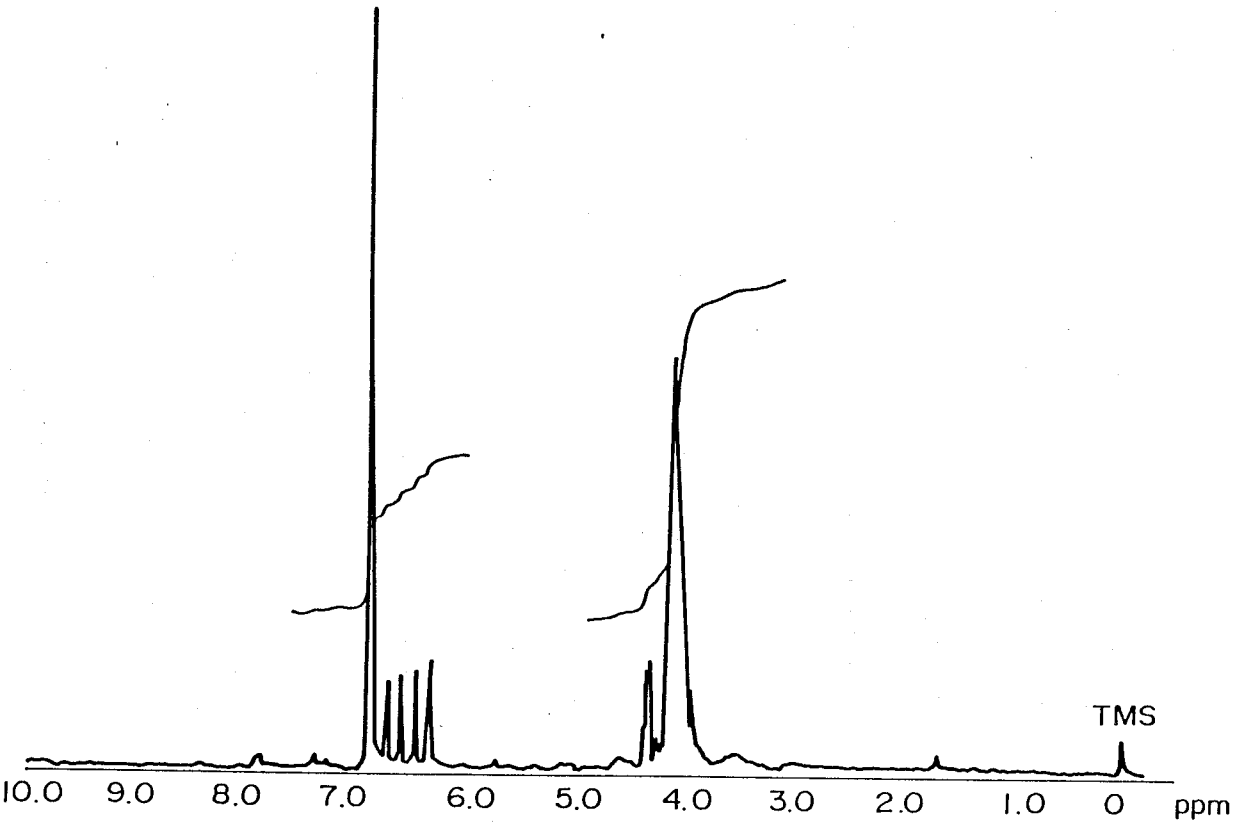
FIG. 1 is an NMR chart of a vinyl ether compound obtained in Example 1.

FIG. is an infrared absorption spectrum of vinyl ether compound obtained in Example 2.

DETAILED DESCRIPTION OF THE PREFERRED EMBODIMENTS

Any of the vinyl ether compounds for use in the present invention can be prepared without difficulty. For example, 1,4-di(vinyloxyethoxy)benzene can be prepared by the following steps:

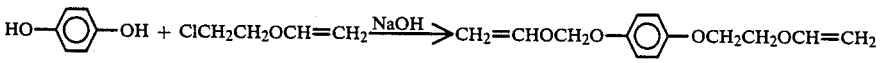

(1)

-continued

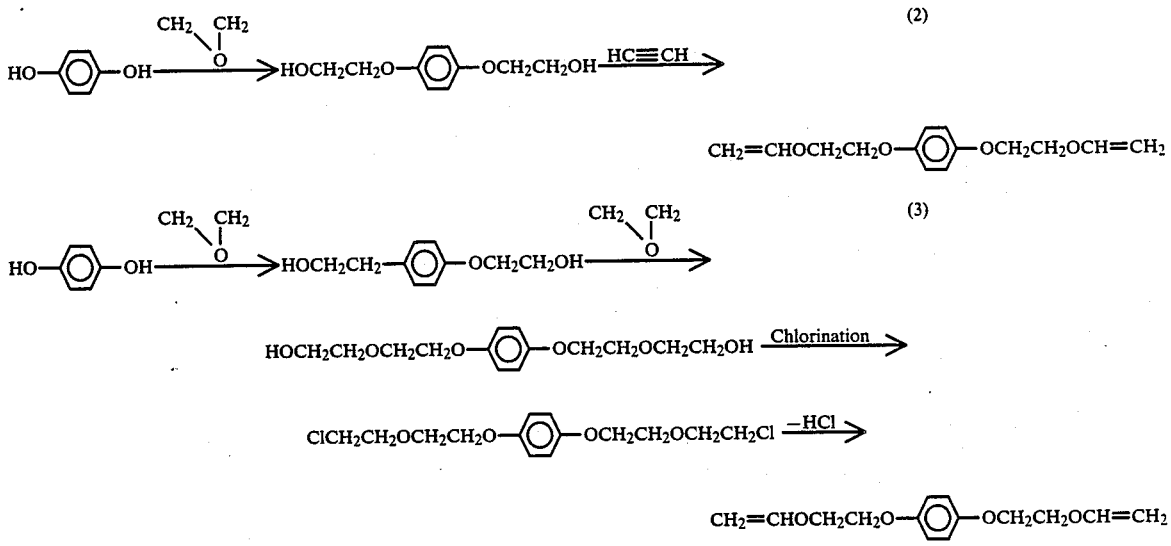

The vinyl ether compounds can be used as thermosensitivity improvement agent for use in a thermosensitive recording material. The thermosensitive recording material using any of the vinyl ether compounds is significantly improved on the stability of the background and image areas and the coloring performance, in particular, for high speed recording.

In contrast to this, thermosensitive recording materials using a conventional sensitizer, known as a melting point decreasing agent, for example, a variety of waxes, fatty acid amides, alkylated biphenyl, substituted biphenyl alkane, coumarin and diphenylamine, have the shortcoming that the clored image density, thermal sensitivity and the degree of whiteness of the background are unsatisfactory for use in practice.

When a thermosensitive recording material using the vinyl ether compound according to the present invention is prepared, the vinyl ether compound may be used together with a coloring system comprising a conventional leuco dye and a color developer.

As the leuco dyes for use in the present invention, any conventional leuco dyes for use in conventional thermosensitive recording materials can be employed. For example, triphenylmethane-type leuco compounds, fluoran-type leuco compounds, phenothiazine-type leuco compounds, auramine-type leuco compounds, spiropyran-type leuco componds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-isoamylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran, 3-(N-methyl-N-isopropylamino)-6-methyl-7-anilinofluoran,
3-dibutylamino-6-methyl-7-anilinofluoran,
3,6-bis(dimethylamino)fluorenespiro(9.3')-6'-dimethylaminophthalide,
3-(N-benzyl-N-cyclohexylamino)-5,6-benzo-7-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfrylamino-6-methyl-7-anilinofluoran, and
3-diethylamino-6-methyl-7-mesidino-4',5'-benzofluoran.

As the color developers for use in combination with the above leuco dyes in the present invention, a variety of electron acceptors can be employed, such as phenolic materials, thiophenol compounds, thiourea derivatives, organic acids and metal salts thereof.

Specific examples of the above color developers are as follows: 4,4'-isopropylidenebisphenol, 4,4'-isopropylidenebis(o-methylphenol), 4,4'-sec-butylidenebisphenol, 4,4'-isopropylidenebis(2-tert-butylphenol), 4,4'-cyclohexylidenediphenol, 4,4'-isopropylidenbis(2-chlorophenol), 2,2'-methylenebis(4-methyl-6-tert-butylphenol), 2,2'-methylenebis(4-ethyl-6-tert-butylphenol), 4,4'-butylidenbis(6-tert-butyl-2-methyl)phenol, 4,4'-thiobis(6-tert-butyl-2-methyl)phenol, 4,4'-diphenolsulfone, 4-isopropoxy-4'-hydroxydiphenylsulfone, 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,7-bis(4-hydroxyphenylthio)-3,5-dioxaheptane, 1,5-bis(4-hydroxyphenylthio)-3-oxapentane, 1,3-bis(4-hydroxyphenylthio)-propane, 1,3-bis(4-hydroxy-phenylthio)-2-hydroxypropane, N,N'-diphenylthiourea, N,N'-di(m-chlorophenyl)thiourea, salicylanilide, 5-chloro-salicylanilide, salicyl-o-chloranilide, 2-hydroxy-3-naphthoic acid, 2-hydroxy-1-naphthoic acid, 1-hydroxy-2-naphthoic acid, and metal salts of hydroxy naphthoic acid such as zinc, aluminum and calcium salts.

In the present invention, a variety of conventional binder agents can be employed for binding the above mentioned leuco dyes, color developers, and the vinyl ether compound, with further addition of an auxiliary agent when necessary, in the thermosensitive coloring layer to the support material.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivative copolymer.

Further in the present invention, auxiliary additive components which are employed in the conventional thermosensitive recording materials, such as a filler, a surface active agent and a thermofusible material (or unguent), can be employed.

Specific examples of a filler for use in the present invention are finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea-formaldehyde resin, styrene/methacrylic acid copolymer, and polystyrene.

The thermosensitive recording material according to the present invention can be prepared, for example, by applying a thermosensitive coloring layer formation liquid containing the above-mentioned components to an appropriate support material such as paper, synthetic paper or a plastic film, and drying the applied liquid. The preferable amounts of the leuco dye, the color developer and the vinyl ether compound are respectively 5 to 40 wt.%, 20 to 60 wt.% and 20 to 60 wt.% based on the total amount of the three components.

PREPARATION EXAMPLE 1

[Preparation of 1,4-di(vinyloxyethoxy)benzene]

7 g of hydroquinone was dissolved in 20 ml of dimethyl sulfoxide. To this solution, an aqueous solution of sodium hydroxide consisting of 5.3 g of sodium hydroxide and 5 ml of water was added.

To this mixture, 14.2 g of 2-chloroethyl vinyl ether was dropwise added, after which the mixture was heated with stirring for 1 hour and then cooled to room temperature. This reaction mixture was poured into 1 l of water. As a result, a product precipitated in the form of crystals. The product was filtered off, washed well with water, and then recrystallized from a mixed solvent of water and ethanol, whereby 1,4-di(vinyloxyethoxy)-benzene was obtained in the form of white crystals, having a melting point of 103°-104° C. The yield was 12.0 g.

The results of elemental analysis of the thus obtained 1,4-di(vinyloxyethoxy)benzene were as follows:

| | % H | % C |
|---|---|---|
| Found | 7.19 | 67.06 |
| Calculated | 7.25 | 67.18 |

Figure 2:
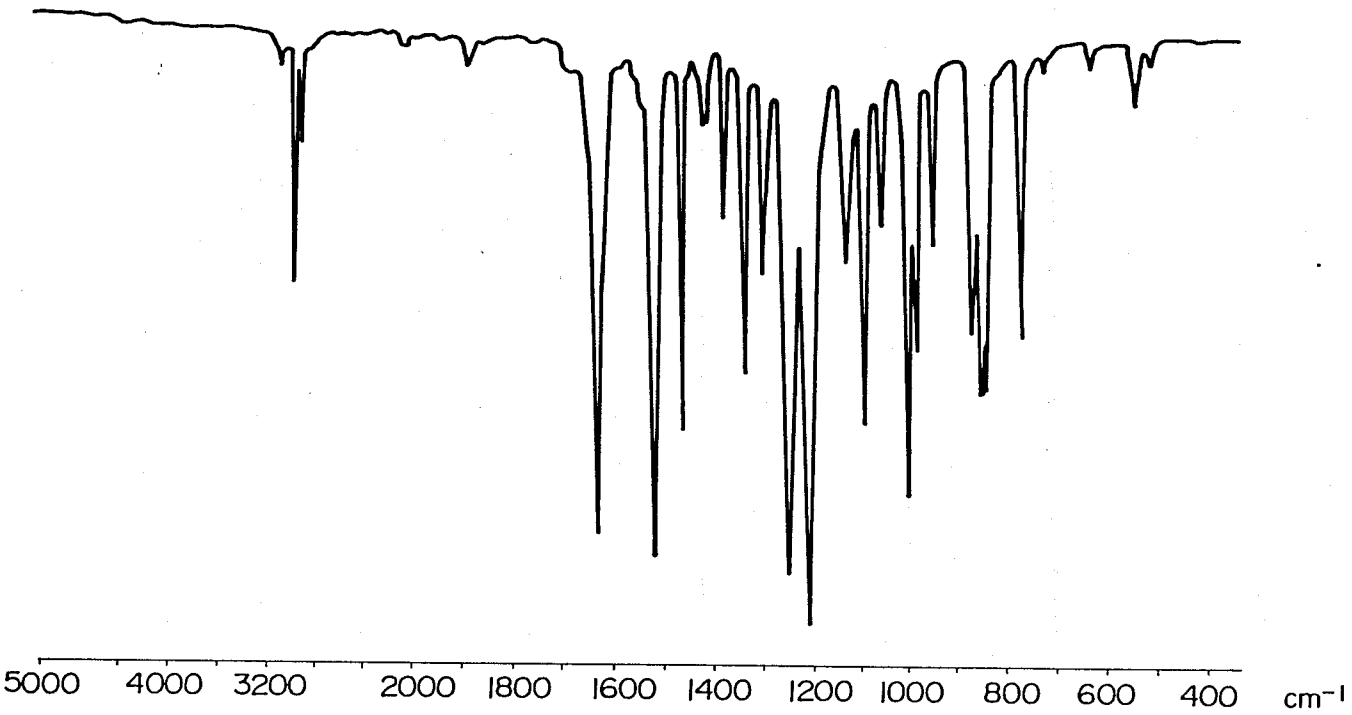
FIG. 2 is an infrared absorption spectrum of the vinyl ether compound obtained in Example 1.

An NMR chart and an infrared absorption spectrum of this compound are respectively shown in FIG. 1 and FIG. 2.

PREPARATION EXAMPLE 2

[Preparation of 1,3-di(vinyloxyethoxy)benzene]

Preparation Example 1 was repeated except that hydroquinone employed in Preparation Example 1 was replaced by resorcin, whereby 1,3-di(vinyloxyethoxy)-benzene was obtained in the form of white crystals, having a melting point of 83°-85° C. The yield was 11.5 g.

The results of elemental analysis of the thus obtained 1,3-di(vinyloxyethoxy)benzene were as follows:

| | % H | % C |
|---|---|---|
| Found | 7.29 | 67.10 |
| Calculated | 7.25 | 67.18 |

Figure 3:
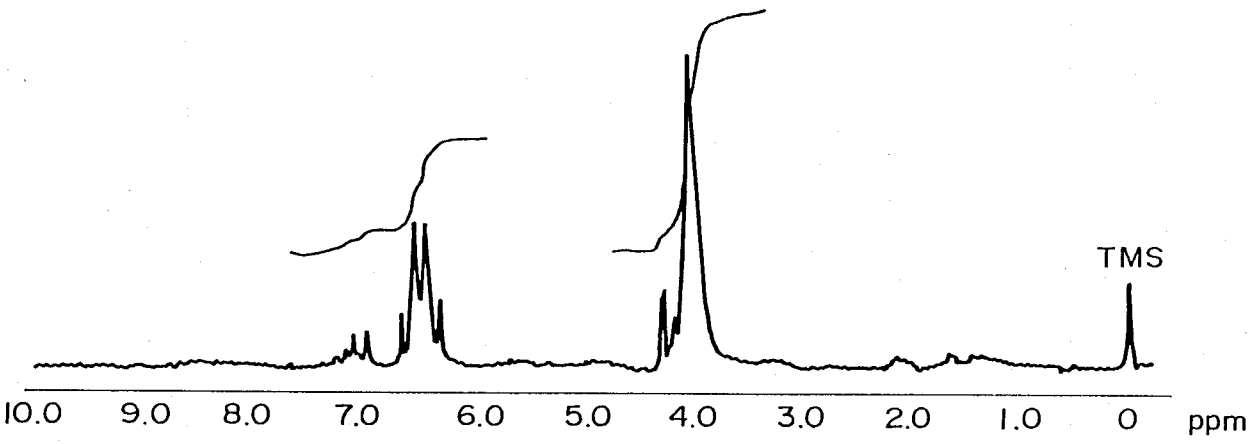
FIG. 3 is an NMR chart of a vinyl ether compound obtained in Example 2.
Figure 4:
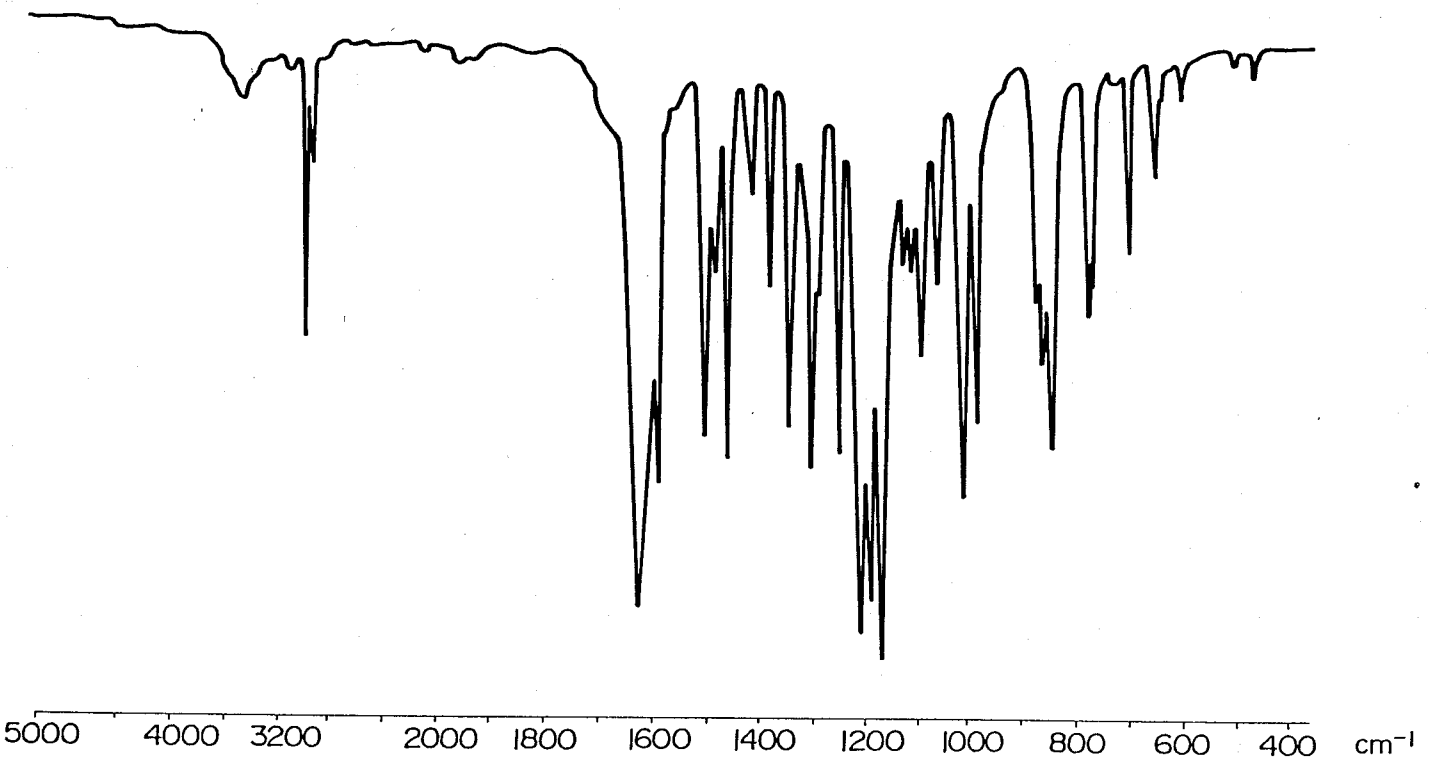

An NMR chart and an infrared absorption spectrum of this compound are respectively shown in FIG. 3 and FIG. 4.

PREPARATION EXAMPLE 3

[Preparation of 1,2-di(vinyloxyethoxy)benzene]

Preparation Example 1 was repeated except that hydroquinone employed in Preparation Example 1 was replaced by catechol, whereby 1,2-di(vinyloxyethoxy)-benzene was obtained in the form of white cyrstals, having a melting point of 44°–46° C. The yield was 11.2 g.

The results of elemental analysis of the thus obtained 1,2-di(vinyloxyethoxy)benzene were as follows:

| | % H | % C |
|---|---|---|
| Found | 7.20 | 67.03 |
| Calculated | 7.25 | 67.18 |

Embodiments of the thermosensitive recording material according to the present invention will now be explained with reference to the following examples.

EXAMPLE 1

A dispersion A, a dispersion B, a dispersion C, and a dispersion D were separately prepared by grinding and dispersing the following respective components in a ball mill

| | Parts by Weight |
|---|---|
| [Dispersion A] | |
| 3-(N—methyl-N—cyclohexylamino)-6-methyl-7-anilinofluoran | 20 |
| 10% aqueous solution of polyvinyl alcohol | 20 |
| Water | 60 |
| [Dispersion B] | |
| Bisphenol A | 20 |
| 10% aqueous or hydroxy-ethylcellulose | 20 |
| Water | 60 |
| [Dispersion C] | |
| 1,4-d1(vinyloxyethoxy)benzene | 20 |
| 10% aqueous solution of polyvinyl alcohol | 20 |
| Water | 60 |
| [Dispersion D] | |
| Calcium carbonate | 20 |
| 5% aqueous solution of methyl-cellulose | 20 |
| Water | 60 |

10 parts by weight of the dispersion A, 30 parts by weight of the dispersion B, 30 parts by weight of the dispersion C, 20 parts by weight of the dispersion D and 10 parts by weight of a 20% aqueous alkali solution of isobutylenen maleic anhydride copolymer were mixed to prepare a thermosensitive coloring layer coating liquid.

This thermosensitive coloring layer coating liquid was coated on a sheet of high quality paper (a basis weight of 50 g/m$^2$) in such a manner that the deposition of dye component being 0.5 g/m$^2$ on a dry basis, and then dried, whereby a thermosensitive coloring layer was formed thereon. The thus prepared thermosensitive recording material was subjected to calendering, so that the surface of the thermosensitive coloring layer was made smooth to the degree ranging from 500 to 600 sec, whereby a thermosensitive recording material No. 1 according to the present invention was prepared.

EXAMPLE 2

Example 1 was repeated except that the dispersion C employed in Example 1 was replaced by a dispersion E with the following formulation, whereby a thermosensitive recording material No. 2 according to the present invention was prepared.

| | Parts by Weight |
|---|---|
| [Dispersion E] | |
| 1,3-di(vinyloxyethoxy)benzene | 20 |
| 10% aqueous solution of polyvinyl alcohol | 20 |
| Water | 60 |

EXAMPLE 3

Example 1 was repeated except that the dispersion C employed in Example 1 was replaced by a dispersion F with the following formulation, whereby a thermosensitive recording material No. 3 according to the present invention was prepared.

| | Parts by Weight |
|---|---|
| [Dispersion F] | |
| 1,2-di(vinyloxyethoxy)benzene | 20 |
| 10% aqueous solution of polyvinyl alcohol | 20 |
| Water | 60 |

COMPARATIVE EXAMPLE 1

Example 1 was repeated except that the dispersion C employed in Example 1 was replaced with water, whereby a comparative thermosensitive recording material No. 1 was prepared.

COMPARATIVE EXAMPLE 2

Example 1 was repeated except that the dispersion C employed in Example 1 was replaced by a dispersion G with the following formulation, whereby a comparative thermosensitive recording material No. 2 was prepared.

| | Parts by Weight |
|---|---|
| [Dispersion G] | |
| Stearamide | 20 |
| 5% aqueous solution of methyl-cellulose | 20 |
| Water | 60 |

The thus prepared thermosensitive recording materials No. 1 through 3 according to the present invention and the comparative thermosensitive recording materials No. 1 and No. 2 were subjected to thermal printing by use of a thermal printing test apparatus including a thermal head of a thin film type (made by Matsushita Electronic Components Co., Ltd.) under the conditions that the power applied to the head was 0.45 W/dot, the recording time per line was 20 msec, the scanning line density was 8×3.85 dots/mm, with the pulse width applied thereto changed to 3 steps of 1.6 msec, 2.0 msec, and 2.4 msec. The density of the developed images was measured by Macbeth densitometer RD-514 with a filter W-106. The results are shown in the following Table 1.

TABLE 1

| | Thermo-sensitive Recording Material | Developed Image Density Pulse width (msec) 1.6 | 2.0 | 2.4 | Back-ground Density |
|---|---|---|---|---|---|
| Example 1 | No. 1 | 0.97 | 1.15 | 1.30 | 0.08 |
| Example 2 | No. 2 | 1.03 | 1.18 | 1.31 | 0.08 |
| Example 3 | No. 3 | 1.10 | 1.21 | 1.31 | 0.08 |
| Comparative Example 1 | No. 1 | 0.55 | 0.85 | 1.05 | 0.08 |
| Comparative Example 2 | No. 2 | 0.80 | 1.10 | 1.27 | 0.08 |

The thermosensitive recording materials No. 1 and No. 2 according to the present invention and the comparative thermosensitive recording materials No. 1 and No. 2 were then subjected to a preservative test by allowing each sample to stand at 60° C. for 24 hours to investigate the changes in the background density before the test and after the test. The results are as shown in Table 2.

TABLE 2

| | Thermo-sensitive Recording Material | Background Density Before Test | After Test | Formation of white powder-like material |
|---|---|---|---|---|
| Example 1 | No. 1 | 0.08 | 0.10 | o |
| Example 2 | No. 2 | 0.08 | 0.09 | o |
| Comparative Example 1 | No. 1 | 0.08 | 0.09 | x |
| Comparative Example 2 | No. 2 | 0.08 | 0.14 | x |

(Note)
o: No white powder-like material was formed on the thermosensitive recording material after the test.
x: A white powder-like material was formed on the thermosensitive recording material after the test.

The results shown in Table 1 and Table 2 indicate that the thermosensitive recording materials using the vinyl ether compounds as thermosensitivity improvement agent according to the present invention are excellent in coloring performance at high speed recording and the stability of the background area and the formed images.

What is claimed is:

1. A thermosensitive recording material, comprising: a support material and a thermosensitive coloring layer formed thereon comprising a leuco dye, a color developer capable of inducing color formation in said leuco dye upon application of heat thereto selected from the group consisting of phenolic materials, thiophenol compounds, thiourea derivatives, organic carboxylic acids and metal salts thereof and a vinyl ether compound having the formula (I):

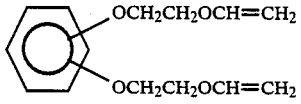

(I)

2. The thermosensitive recording material as claimed in claim 1, wherein said leuco dye is selected from the group consisting of triphenylmethane-type leuco compounds, flouran-type leuco compounds, phenothiazine-type leuco compounds, auramine-type leuco compounds, spiropyran-type leuco compounds and indolinophthalide-type leuco compounds.

3. The thermosensitive recording material as claimed in claim 1, wherein the amounts of said leuco dye, said color developer and said vinyl ether compound are respectively in the range of 5 to 40 wt.%, 20 to 60 wt.% and 20 to 60 wt.% based on the total amount by weight of said three components.

4. The thermosensitive recording material as claimed in claim 1, wherein said leuco dye is a member selected from the group consisting of 3,3-bis(p-dimethylaminophenyl)-phthalide, 3,3-bis(p-dimethylaminophenyl)-6-dimethylaminophthalide (or Crystal Violet Lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-dietylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-trifluoromethylphenyl)amino]-6-diethylaminofluoran, 2-8 3,6-bis(diethylamino)-9-(o-chloroanilino)xanthylbenzoic acid lactam], 3-diethylamino-6-methyl-7-(m-trichloromethylanilino)-fluroan, 3-diethylamino-7-(o-chloroanilino)fluoran, 3-dibutylamino-7-(o-chloroanilino)fluoran, 3-N-methyl-N-isoamylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino, benzoyl leuco methylene blue, 6'-chloro-8'-methoxy-benzoindolinospiropyran, 6'-bromo-3'-methoxy-benzoindolino-spiropyran, 3-(2'-hydroxy-4'-dimethylaminophenyl)-3-(2-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluroran, 3-diethylamino-5-chloro-7-(N-benzyltrilfuoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)-fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)-fluoran, 3-(N-methyl-N-isopropylamino)-6-methyl-7-anilinofluoran, 3-dibutylamino-6-methyl-7-anilinofluoran, 3,6-bis(dimethylamino)fluorenespiro (9.3')-6'-dimethylaminophthalide, 3-(N-benzyl-N-cyclohexylamino)-5,6-benzo-7-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, and 3-diethylamino-6-methyl-7-mesidino-4',5'-benzofluoran.

5. The thermosensitive recording material as claimed in claim 1, wherein said color developer is a member selected from the group consisting of 4,4'-isopropylidenebisphenol, 4,4'-isopropylidene-bis(o-methylphenol), 4,4'-sec-butylidenebisphenol, 4,4'-isopropylidenebis(2-tert-butylphenol), 4,4'-cyclohexylidenediphenol, 4,4'-isopropylidenbis(2-chlorophenol), 2,2'-methylenebis(4-methyl-6-tert-butylphenol), 2,2'-methylenebis(4-ethyl-6-tert-butylphenol), 4,4'-butylidenebis(6-tert-butyl-2-methyl)phenol, 4,4'-thiobis(6-tert-butyl-2-methyl) phenol, 4,4'-diphenosulfone, 4-isopropoxy-4'-hydroxy-diphenylsulfone, 4-benzyloxy-4'-hydroxydiphenylsulfone, 4,4'-diphenosulfoxide, isopropyl p-hydroxybenzoate, benzyl p-hydroxybenzoate, benzyl protocatechuate, stearyl gallate, lauryl gallate, octyl gallate, 1,7-bis(4-hydroxyphenylthio)-3,5-dioxa-heptane, 1,5-bis(4-hydroxyphenylthio)-3-oxapentane, 1,3-bis(4-hydroxyphenylthio)-propane, 1,3-bis(4-hydroxy-phenylthio)-2-hydroxypropane, N,N'-diphenylthiourea, N,N'-di(m-chlorophenyl)thiourea, salicylanilide, 5-chlorosalicylanilide, salicyl-o-chloroanilide, 2-hydroxy-3-naphthoic acid, 2-hydroxy-1-naphthoic acid, 1-hydroxy-2-naphthoic acid, and metal salts of hydroxynaphthoic acid.

6. The thermosensitive recording material as claimed in claim 1, which further comprises a binder for the components of the coloring layer selected from the group consisting of polyvinyl alcohol, starch and starch derivatives, cellulose derivatives sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin, casein and latexes.

7. The thermosensitive recording material as claimed in claim 1, which further comprises a filter selected from the group consisting of finely-divided inorganic powders of calcium carbonate, silica, zinc oxide, titanium oxide, aluminum hydroxide, zinc hydroxide, barium sulfate, clay, talc, surface-treated calcium and surface-treated silica, and finely-divided organic powders of urea - formaldehyde resin, styrene/methacrylic acid copolymer, and polystryrene.

8. The thermosensitive recording material as claimed in claim 1, wherein the amounts of said leuco dye, color developer and vinyl ether compound are respectfully 5 to 40 wt.%, 20 to 60 wt.% and 20 to 60 wt.% based on the total amount of the three components.

* * * * *

UNITED STATES PATENT AND TRADEMARK OFFICE

CERTIFICATE OF CORRECTION

PATENT NO. : 4,845,072

DATED : July 4, 1989

INVENTOR(S) : Hiromi Furuya et al

It is certified that error appears in the above-identified patent and that said Letters Patent is hereby corrected as shown below:

Column 2, last line:

" 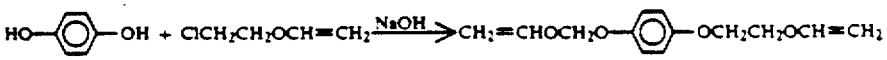 (1) "

should read

-- 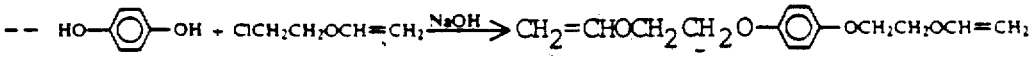 (1) --.

Column 3, line 1: "$CH_2$ $CH_2$" should read -- $CH_2$—$CH_2$ --;

second formula:

"$CH_2$ $CH_2$" should read -- $CH_2$—$CH_2$ --.

Column 4, second formula:

"$CH_2$ $CH_2$" should read -- $CH_2$—$CH_2$ --.

Signed and Sealed this

Ninth Day of July, 1991

*Attest:*

HARRY F. MANBECK, JR.

*Attesting Officer*

*Commissioner of Patents and Trademarks*